US007033216B2

(12) United States Patent
Ito

(10) Patent No.: US 7,033,216 B2
(45) Date of Patent: Apr. 25, 2006

(54) WATERTIGHT CONNECTOR

(75) Inventor: Osamu Ito, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/998,094

(22) Filed: Nov. 24, 2004

(65) Prior Publication Data

US 2005/0118850 A1 Jun. 2, 2005

(30) Foreign Application Priority Data

Nov. 27, 2003 (JP) ..... 2003-397525

(51) Int. Cl.
*H01R 13/52* (2006.01)

(52) U.S. Cl. ..... 439/587; 439/275

(58) Field of Classification Search ..... 439/275, 439/274, 271, 595, 587, 588, 589
See application file for complete search history.

(56) References Cited

U.S. PATENT DOCUMENTS 4,713,021 A 12/1987 Kobler ..... 439/272
5,634,807 A * 6/1997 Saito ..... 439/275
5,931,699 A * 8/1999 Saito ..... 439/587
6,053,753 A * 4/2000 Kunkle ..... 439/275
6,071,147 A * 6/2000 Tsukamoto ..... 439/587
6,152,752 A * 11/2000 Fukuda ..... 439/275
6,343,952 B1 2/2002 Fukuda
6,368,132 B1 * 4/2002 Okayasu ..... 439/273
6,383,022 B1 5/2002 Murakami et al.
6,739,908 B1 * 5/2004 Hamai et al. ..... 439/587
2003/0207607 A1 11/2003 Matsumoto et al.

FOREIGN PATENT DOCUMENTS

JP 2002-343492 11/2002

* cited by examiner

*Primary Examiner*—Hien Vu
(74) *Attorney, Agent, or Firm*—Gerald E. Hespos; Anthony J. Casella

(57) ABSTRACT

A one-piece rubber plug (30) of the hybrid type is mounted at a rear side of a female housing (20). Wire insertion holes (32) of the rubber plug (30) include large-diameter portions (34) and small-diameter portions (33). The outer circumferential surfaces of sealing plugs (60) corresponding to larger terminals (20A) are resiliently brought into close contact with the inner circumferential surfaces of the large-diameter portions (34), whereas the outer circumferential surfaces of wires (33) are resiliently brought into close contact with the outer circumferential surfaces of wires (50) corresponding to small terminals (20B).

12 Claims, 5 Drawing Sheets

WATERTIGHT CONNECTOR

BACKGROUND OF THE INVENTION

1. Field of the Invention

The present invention relates to a watertight connector.

2. Description of the Related Art

Japanese Unexamined Patent Publication No. 2002-343492 discloses a watertight connector with a housing that has a plurality of cavities for accommodating female terminal fittings. A one-piece rubber plug is arranged at the rear of the cavities and has wire insertion holes that align respectively with the cavities. A holder is mounted behind the rubber plug and has terminal insertion openings that correspond respectively to the wire insertion holes. Each female terminal fitting is secured to the end of a wire and is inserted through a terminal insertion opening of the holder. The female terminal fitting then resiliently widens the wire insertion hole and penetrates the rubber plug. Finally, the female terminal fitting is pressed into the respective cavity. The rubber plug returns resiliently after the female terminal fitting has passed so that the inner surface of the wire insertion hole closely contacts the outer circumferential surface of the wire to provide sealing.

An ordinary female terminal fitting has a rectangular tubular main portion with a contact tongue therein. The wire extends back from the main portion of the female terminal fitting and has an outer diameter slightly smaller than dimensions of the outer shape of the main portion. The diameter of the wire insertion hole must be set to closely contact the outer circumferential surface of the wire. Dimensions of the outer shapes of the main portion are significantly larger than the diameter of the wire insertion hole if the female terminal fitting is large. Accordingly, the main portion of the female terminal fitting may not be easily insertable through the wire insertion hole. Forcible insertion of the main portion through the wire insertion hole can tear or break the rubber plug, and hence may deteriorate sealing performance.

The invention was developed in view of the above problem and an object thereof is to avoid a reduction in sealing performance caused by the breakage of a rubber plug.

SUMMARY OF THE INVENTION

The invention relates to a watertight connector that has a housing formed with cavities. A resilient plug is mounted to a rear end of the housing and has at least one wire insertion hole that correspond to at least one cavity. The connector also includes at least one terminal fitting that is secured to an end of a wire. A main portion of the terminal fitting projects forward of the wire and has an outer shape that is larger than the outer diameter of the wire. A sealing plug is mounted on the wire behind the main portion of the terminal fitting. The main portion of the terminal fitting is inserted through the wire insertion hole and into the cavity. The sealing plug then is inserted into the wire insertion hole of the resilient plug. Thus, the inner circumferential surface of the sealing plug closely contacts the outer circumferential surface of the wire and the inner circumferential surface of the wire insertion hole plug closely contacts the outer circumferential surface of the sealing plug to provide reliable sealing.

The resilient plug preferably is formed from one-piece and has a plurality of wire insertion holes that correspond respectively to the cavities. The wire insertion holes preferably have a plurality of hole diameters that correspond to terminal fittings with differently sized main portions. The large main portion is inserted through a large wire insertion hole to avoid excessive interference between the large main portion and the resilient plug. However, the sealing plug is mounted to the wire that is secured to the terminal fitting with the large main portion. The inner circumferential surface of the large wire insertion hole closely contacts the outer circumferential surface of the sealing plug to provide good sealing. The terminal fitting with the small main portion is inserted through a small wire insertion hole and the inner circumferential surface of the small wire insertion hole closely contacts the outer circumferential surface of the wire. Thus, excessive enlargement of the resilient plug is avoided, and the resilient plug can be applied widely from smaller terminal fittings to larger terminal fitting.

The diameters of all wire insertion holes are set so that the main portions of the terminal fittings can be inserted without stretching the resilient plug excessively.

The diameters of at least some wire insertion holes are larger than in the prior art to facilitate insertion of the large main portions of the terminal fittings. Hence, the resilient plug could be large. However, the resilient plug preferably is made of one-piece, and adjacent wire insertion holes share partition walls. Therefore, the resilient plug need not become larger.

DETAILED DESCRIPTION OF THE PREFERRED EMBODIMENTS

Figure 1:
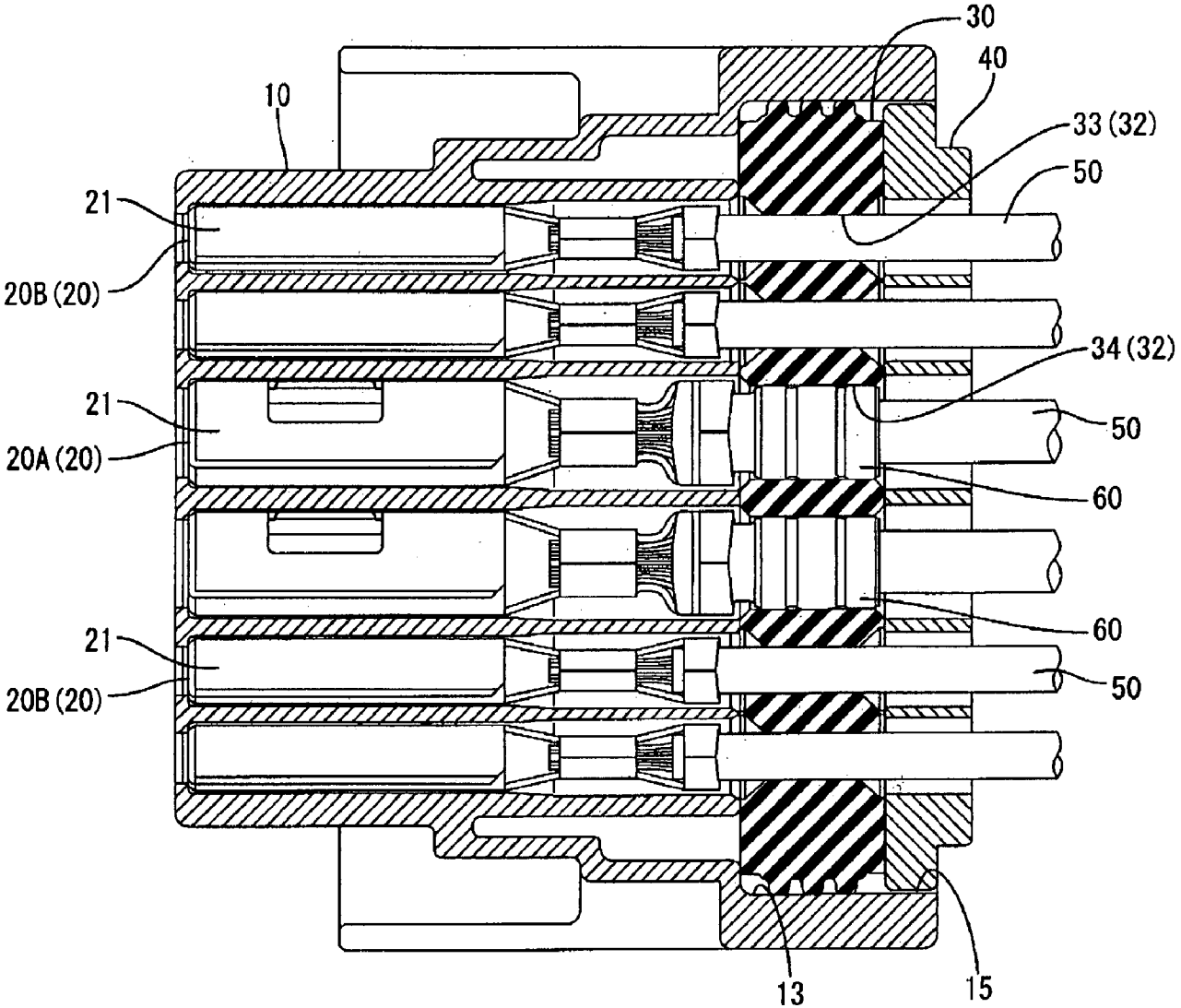
FIG. 1 is a section of one embodiment of the invention.

A female watertight connector according to the invention is described with reference to FIGS. 1 to 6. The female watertight connector includes a female housing 10 that has a plurality of female terminal fittings 20, a one-piece rubber plug 30 and a rubber-plug holder 40. In the following description, the left side in FIG. 1 is referred to as the front.

Figure 5:
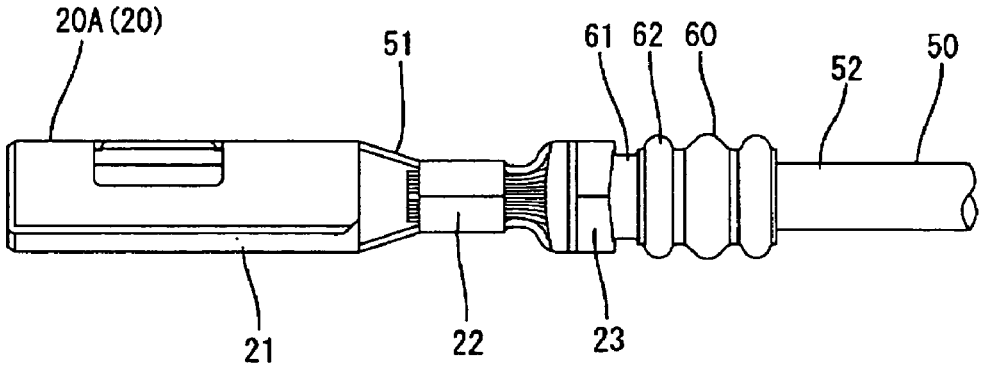
FIG. 5 is a plan view of a larger terminal.
Figure 6:
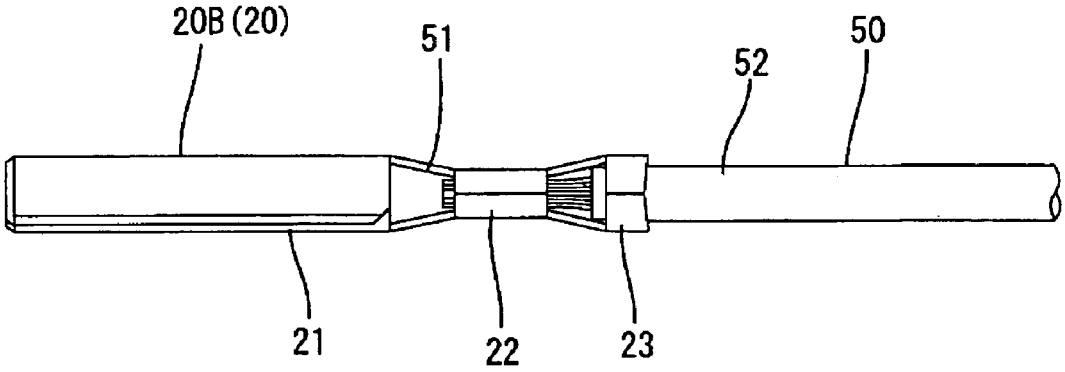
FIG. 6 is a plan view of a smaller terminal.

As shown in FIGS. 5 and 6, the female terminal fittings 20 have different sizes, but substantially identical construction. Specifically, each female terminal fitting 20 is formed by press-forming an electrically conductive metal plate and has opposite front and rear ends. A rectangular tubular main portion 21 is formed at the front end of the female terminal fitting 20. A contact tongue (not shown) is formed in the main portion 20 for contacting a tab of a mating male terminal fitting (not shown). A wire barrel 22 and an insulation barrel 23 are coupled integrally behind the main portion 21 in this order. The female terminal fitting 20 is secured to an end of a wire 20 by crimping the wire barrel 22 into connection with an end of a core 51 (FIGS. 5 and 6) and by crimping the insulation barrel 23 into connection with an end of an insulation coating 52. A sealing plug 60 is mounted hermetically on the end of the insulation coating 52 intended for a larger female terminal 20A, as shown in FIG. 5, and the insulation barrel 23 of the larger female terminal fitting 20A is crimped into connection with the sealing plug 60.

The outer shape of the main portion 21 of the larger terminal 20A is considerably larger than the outer diameter of the wire 50 and substantially equal to the outer diameter of the sealing plug 60 fit on the wire 50. A front part of the outer circumferential surface of the sealing plug 60 serves as a connecting surface with the insulation barrel 23, and circumferentially extending lips 62 are formed side by side on a rear part of the outer circumferential surface. On the other hand, the outer shape of the main portion 21 of the smaller terminal 20B is only slightly larger than the outer diameter of the wire 50, and, as shown in FIG. 6, no sealing plug 60 is mounted on the wire 50 for the smaller terminal 20B.

Figure 2:
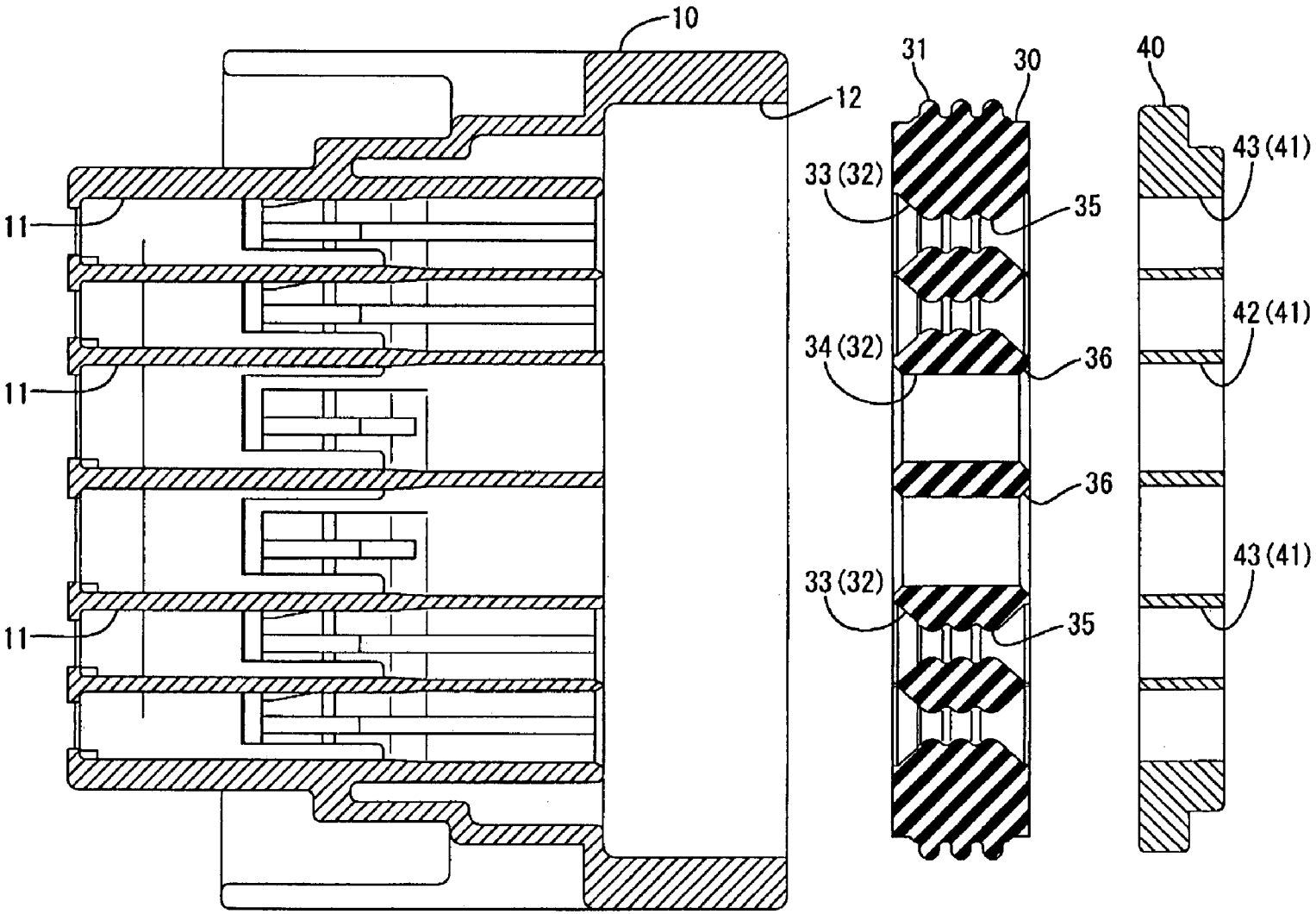
FIG. 2 is an exploded section of a female housing, a rubber plug and a rubber-plug holder.

The female housing 10 is a wide block formed of a synthetic resin and a side-by-side array of six cavities 11 penetrate the female housing 10 in forward and backward directions, as shown in FIG. 2. The female terminal fittings 20 are insertable into the corresponding cavities 11 from behind. The two middle cavities 11 have large diameter holes for receiving to the larger terminals 20A. The remaining cavities 11 have small diameter holes for receiving to the smaller terminal fittings 20B.

Figure 4:
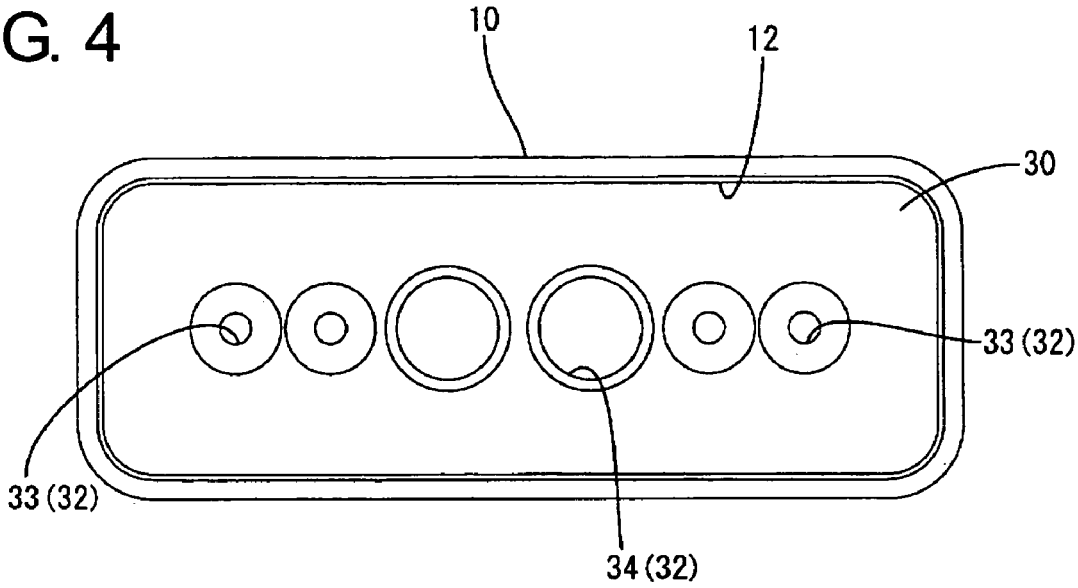
FIG. 4 is a rear view of the female housing.

A mount hole 12 is formed at a rear side of the female housing 10 and has an open rear end for receiving the rubber plug 30 and the rubber-plug holder 40. As shown in FIG. 4, the mount hole 12 has a wide rectangular cross section with somewhat rounded corners, and the rubber plug 30 is fit into the mount hole 12 contacting the back wall.

The rubber plug 30 is of unitary construction, and is dimensioned to cover the rear surfaces of all of the cavities 11. The rubber plug 30 has a large thickness and is dimensioned to fit closely at a backside 13 of the mount hole 12. Lips 31 are formed on the outer circumferential surface of the rubber plug 30, as shown in FIG. 2, and can be brought resiliently into close contact with the inner circumferential surface of the backside 13 of the mount hole 12. The rubber plug 30 is transversely symmetrical with respect to an axis extending along forward and backward directions and located in the transverse middle. Thus, the front and rear sides of the rubber plug 30 are indistinguishable to prevent erroneous mounting.

The rubber plug 30 has wire insertion holes 32 at positions corresponding to the cavities 11. The main portions 21 of the female terminal fittings 20 pass the wire insertion holes 32 from behind, and then the ends of the wires 50 and the sealing plugs 60 enter the wire insertion holes 32. There are two kinds of wire insertion holes 32 having diameters corresponding to the larger terminals 20A and smaller terminals 20B. Specifically, small wire insertion holes 33 permit passage of the main portions 21 of the smaller terminals 20B and large wire insertion holes 34 permit passage of the main portions 21 of the larger terminals 20A.

Lips 35 are formed on the inner circumferential surface of each small hole 33 for resiliently contacting the outer circumferential surface of the wire 50. Specifically, the tips of the lips 35 of the small holes 33 define diameters that correspond to the outer diameter of the wire 50. The main portion 21 of the smaller terminal 20B has an outer shape with dimensions that are not much different from the outer diameter of the wire 50. Thus, interference of the main portion 21 with the rubber plug 30 is not a significant hindrance when the main portion 21 passes the small hole 33.

The inner circumferential surface of each large hole 34 is cylindrical along forward and backward directions except in short areas at the front and rear ends where conically widened guiding surfaces 36 are formed for guiding the insertion of the female terminal fitting 20. The lips 62 at the outer circumferential surface of the sealing plug 60 can be brought resiliently into close contact with the inner circumferential surface of the large hole 34. The diameter of each large hole 34 corresponds to the outer diameter of the sealing plug 60, which is substantially equal to the dimensions of the outer shape of the main portion 21. Thus, interference of the main portion 21 with the rubber plug 30 is not a significant hindrance even when the main portion 21 of the larger portion 20A passes the large hole 34. The diameter of the each large hole 34 is barely smaller than the dimensions of the outer shape of the main portion 21. These dimensions are selected to avoid making the rubber plug 30 larger by setting the hole diameter of the large holes 34 at as small a value as possible within a range where excessive interference with the rubber plug 30.

The rubber-plug holder 40 is made of a synthetic resin and has a large thickness. Additionally, the rubber-plug holder 40 is closely fittable into an entrance side 15 of the mount hole 12. Terminal insertion openings 41 penetrate the rubber-plug holder 40 at positions corresponding to the respective cavities 11 and the respective wire insertion holes 32 through which the female terminal fittings 20 are insertable. The terminal insertion openings 41 include large openings 42 for receiving the main portions 21 of the larger terminals 20A at positions corresponding to the large holes 34, and small openings 43 for receiving the main portions 21 of the smaller terminals 20B at positions corresponding to the small holes 33.

Figure 3:
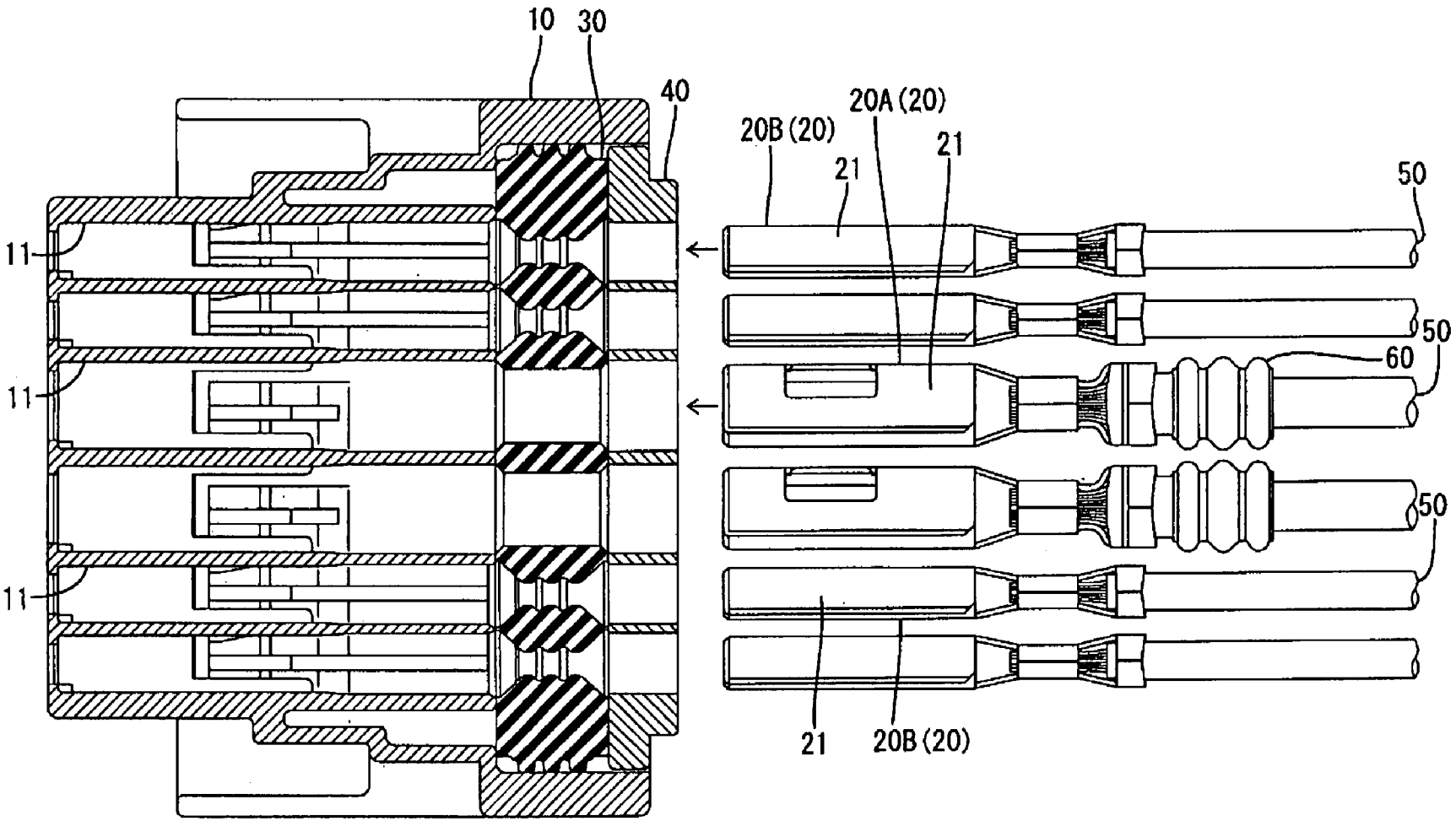
FIG. 3 is a section showing female terminal fittings inserted.

The connector is assembled by fitting the rubber plug 30 into the backside 13 of the mount hole 12 of the female housing 10. The rubber-plug holder 40 then is fit into the entrance side 15 of the mount hole 12 and is pressed against the rear surface of the rubber plug 30, as shown in FIG. 3. The rubber-plug holder 40 prevents the rubber plug 30 from being inclined and coming out of the mount hole 12.

The female terminal fitting 20 is secured to the end of the wire 50 and is inserted through the corresponding terminal insertion opening 41 of the rubber-plug holder 40, as shown by an arrow in FIG. 3. The leading end of the main portion 21 of the female terminal fitting 20 passes the terminal insertion opening 41 and then enters the wire insertion hole 32 of the rubber plug 30. The main portion 21 of the larger terminal 20A then passes the large hole 34. The outer shape of the main portion 21 of the larger terminal 20A is barely larger than the diameter of the large hole 34. Thus, the main portion 21 of the larger terminal 20A can pass the wire insertion hole 32 without any problem. Further, the main portion 21 of the smaller terminal 20B passes the small hole 33. The diameters of the small holes 33 correspond to the outer diameter of the wire 50, and the outer shape of the main portion 21 of the smaller terminal 20B are only slightly larger than the outer diameter of the wire 50. Thus, the main portion 21 of the smaller terminal 20B can widen rubber plug 30 and pass the small hole 33 without any problem.

The female terminal fitting 20 is locked in the corresponding cavity 11 when the leading end of the main portion 21 contacts the front wall of the cavity 11. The sealing plug 60 on the wire 50 is inserted in the large hole 34 when the larger terminal 20A reaches a proper insertion position in the corresponding cavity 11. The lips 62 are contracted resiliently and the outer circumferential surfaces of the lips 62 are held resiliently in close contact with the inner circumferential surface of the large hole 34 so that the sealing plug 60 is accommodated hermetically in the large hole 34. On the other hand, the wire 50 is inserted in the small hole 34 until the smaller terminal 20B reaches a proper insertion position in the corresponding cavity 11. The outer circumferential surface of the wire 50 closely contacts the lips 35 of the small hole 33 to hermetically accommodate the wire 50 in the small hole 33. In this way, the inner surfaces of the wire insertion holes 32 closely contact the outer circumferential surfaces of the wires 50 and the sealing plugs 60 after the female terminal fittings 20 pass the wire insertion holes 32.

As described above, the sealing plugs 60 are connected with the larger terminals 20A out of the female terminal fittings 20 and the outer circumferential surfaces of the sealing plugs 60 are brought resiliently into close contact with the inner circumferential surfaces of the wire insertion holes 32 when the female terminal fittings 20 pass the wire insertion holes 32 of the rubber plug 30. Thus, the diameter of the wire insertion holes 32 can be set to correspond to the outer diameter of the sealing plugs 60. Thus, the main portions 21 can pass the wire insertion holes 32 without causing excessive interference with the rubber plug 30 even if the outer shape of the main portions 21 are larger than the outer diameter of the wires 50. As a result, breakage of the rubber plug 30 which might be caused by the passage of the female terminal fittings 20 can be avoided to maintain a sealing performance.

The diameter of the large wire insertion holes 34 is set so that the inner circumferential surfaces of the large holes 34 can closely contact the outer circumferential surfaces of the sealing plugs 60, i.e. the large holes 34 have a larger diameter and could make the rubber plugs 30 larger. However, if the rubber plug 30 is of the one-piece type, and partition walls between adjacent wire insertion holes 32 can be used in common. Therefore, the rubber plug 30 does not become larger.

This rubber plug 30 is a hybrid that has wire insertion holes 32 of a plurality of hole diameters. Outer circumferential surfaces of the sealing plugs 60 closely contact the inner circumferential surfaces of the large holes 34 and the outer circumferential surfaces of the wires 50 closely contact the inner circumferential surfaces of the small holes 33. Accordingly, excessive interference with the rubber plug 30 is avoided by passing the larger terminals 20A through the large holes 34 and by passing the smaller terminals 20B through the small holes 33 so that the outer circumferential surfaces of the wires 50 closely contact the inner circumferential surfaces of the small holes 33. Interference of the smaller terminals 20B with the rubber plug 30 is not a big problem. Thus, by setting a diameter for the small holes 33, the enlargement of the rubber plug 30 can be avoided. In this way, the rubber plug 30 can be applied widely from the smaller female terminal fittings 20 to the larger female terminal fittings 20, displaying an excellent versatility.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The invention is applied to a female connector with female terminal fittings in the foregoing embodiment. However, the invention is also applicable to male connectors with male terminal fittings. In such a case, a portion corresponding to a main portion of each terminal fitting is a box portion connected with the base end of a tab.

There are two different sizes of terminal fittings in the foregoing embodiment. However, there may be three sizes of terminal fittings according to the invention. In such a case, the outer circumferential surfaces of the sealing plugs mounted on the wires can closely contact the inner circumferential surfaces of the largest wire insertion holes, and the outer circumferential surfaces of the wires can closely contact the inner circumferential surfaces of the smallest wire insertion holes.

The sealing plugs are accommodated in the wire insertion holes of the one-piece rubber plug in the foregoing embodiment. However, the sealing plugs may be accommodated in wire insertion holes of individual rubber plugs corresponding to the respective terminal fittings according to the invention.

The diameters of the wire insertion holes may be set so that the main portions of the terminal fittings are loosely insertable. Thus, the main portions do not interfere with the rubber plug and the rubber plug will not be torn or broken.

What is claimed is:

1. A watertight connector, comprising:

a housing with opposite front and rear ends and a plurality of cavities extending between the ends;

at least one resilient plug mounted in the housing rearward of the cavities, the resilient plug having at least one wire insertion hole substantially corresponding to at least one of the cavities;

terminal fittings having opposite front and rear ends, each said terminal fitting being secured to an end of a wire, the wire defining an outside diameter, each said terminal fitting further having a main portion forward of the respective wire, the main portion of at least a first of said terminal fittings defining an outer shape that is larger than the outer diameter of the respective wire, the main portion of each said terminal fitting being in a corresponding cavity so that a portion of the respective wire passes through the corresponding wire insertion hole;

at least one sealing plug mounted on the wire behind the main portion of the first terminal fitting and disposed in the corresponding wire insertion hole, the sealing plug having an outer circumferential surface held resiliently in close contact with an inner circumferential surface of the wire insertion hole; and a plug holder mounted rearward of and against the resilient plug for holding the resilient plug substantially in the rear end of the housing.

2. The watertight connector of claim 1, wherein the resilient plug is of unitary construction and has a plurality of wire insertion holes corresponding to the respective cavities.

3. The watertight connector of claim 2, wherein:

the main portion of the first terminal fitting is larger than the main portion of at least a second of the terminal fittings;

the inner circumferential surfaces of at least a first and a second of the wire insertion holes have dimensions that correspond respectively to the main portions of the first and second terminal fittings;

the outer circumferential surface of the at least one sealing plug being dimensioned for closely contacting the inner circumferential surface of the first wire insertion hole; and the outer circumferential surface of the wire secured to the second terminal fitting being closely contacted by the inner circumferential surface of the second wire insertion hole.

4. The watertight connector of claim 3, the first wire insertion hole is dimensioned so that the main portion of the first terminal fitting can be inserted loosely therethrough.

5. The watertight connector of claim 3, wherein the outer circumferential surface of the sealing plug has dimensions that substantially correspond to a maximum outer dimension of the main portion of the first terminal fitting.

6. The watertight connector of claim 5, wherein the sealing plug is substantially symmetrical about an axis extending between the front and rear ends of the first terminal fitting.

7. The watertight connector of claim 1, wherein the sealing plug is formed unitarily from a resilient material.

8. The watertight connector of claim 1, wherein the at least one resilient plug consists of a single resilient plug, and the at least one sealing plug comprises a plurality of sealing plugs.

9. A watertight connector, comprising:

a housing with a rear end, at least one small cavity and at least one large cavity extending forward from the rear end;

a resilient plug mounted in the housing rearward of the cavities, the resilient plug having at least one small wire insertion hole and at least one large wire insertion hole aligned with the respective small and large cavities;

small and large terminal fittings having opposite front and rear ends, each of said terminal fittings being secured to an end of a wire and having a main portion forward of the respective wire, the main portion of the large terminal fitting defining an outer shape that is larger than the respective wire, the main portion of each said terminal fitting being in a corresponding cavity so the respective wire passes through the corresponding wire insertion hole;

at least one sealing plug mounted on the wire secured to the large terminal fitting and disposed in the corresponding wire insertion hole, the sealing plug having an outer surface held resiliently in close contact with an inner surface of the large wire insertion hole; and a plug holder mounted rearward of and against the resilient plug for holding the resilient plug substantisally in the rear end of the housing.

10. The watertight connector of claim 9, wherein the sealing plug is formed unitarily from a resilient material.

11. The watertight connector of claim 10, wherein the at least one resilient plug consists of a single resilient plug, and the at least one sealing plug comprises a plurality of sealing plugs.

12. A method for assembling a watertight connector, comprising:

providing a housing having at least one large cavity and at least one small cavity extending therethrough;

mounting a resilient plug substantially in a rear end of the housing, the resilient plug having at least one large wire insertion hole and at least one small wire insertion hole substantially aligned respectively with the large and small cavities;

mounting a sealing plug over an end of a first wire;

mounting a large terminal fitting to the first wire;

mounting a small terminal fitting to a second wire;

inserting the large and small terminal fittings through the respective large and small insertion holes and into the respective large and small cavities so that resilient plug seals against sealing plug and against the second wire; and mounting a plug holder rearward of and against the resilient plug for holding the resilient plug substantially in the rear end of the housing.

* * * * *